United States Patent [19]

Glöckler et al.

[11] 4,304,204

[45] Dec. 8, 1981

[54] METHOD AND APPARATUS FOR FUEL-AIR MIXTURE CONTROL

[75] Inventors: Otto Glöckler, Renningen; Bernd Kraus, Gerlingen, both of Fed. Rep. of Germany

[73] Assignee: Robert Bosch GmbH, Stuttgart, Fed. Rep. of Germany

[21] Appl. No.: 804,655

[22] Filed: Jun. 8, 1977

[30] Foreign Application Priority Data

Jun. 11, 1976 [DE] Fed. Rep. of Germany ..... 2626226
Oct. 29, 1976 [DE] Fed. Rep. of Germany ..... 2649455

[51] Int. Cl.[3] ..... F02B 3/00

[52] U.S. Cl. ..... 123/440; 123/434; 123/445; 60/276; 60/285

[58] Field of Search ..... 60/276, 285; 123/32 EE, 123/32 EA, 119 EC, 440, 445, 434

[56] References Cited

U.S. PATENT DOCUMENTS 3,938,075 2/1976 Reddy ..... 60/285
3,948,081 4/1976 Wessel et al. ..... 60/276
3,962,866 6/1976 Neidhard et al. ..... 60/276
4,019,474 4/1977 Nishimiya et al. ..... 123/32 EE
4,068,472 1/1978 Takata et al. ..... 60/276
4,117,815 10/1978 Ikeura ..... 60/276

*Primary Examiner*—S. A. Cangialosi
*Attorney, Agent, or Firm*—Edwin E. Greigg

[57] ABSTRACT

The fuel-air mixture preparation system of an internal combustion engine is engaged by signals from a plurality of oxygen sensors located in the exhaust system of the engine. More than one sensor is provided to improve the quality of the output signals in unfavorable engine operation. The individual sensors are provided with comparators which make a comparison between the sensor output and a set-point signal. The output signals from the comparators are fed to a logically controlled coupling circuit which presents them in cyclic alternation to an integrating control circuit which provides a control signal to the final control element in the fuel mixture preparation system for changing the fuel-air ratio. The coupling circuit may also provide a signal based on the logical states of the individual sensor signals.

10 Claims, 6 Drawing Figures

METHOD AND APPARATUS FOR FUEL-AIR MIXTURE CONTROL

BACKGROUND OF THE INVENTION

A. Field of the Invention

The invention relates to a method and an apparatus for controlling the mixture ratio of fuel and air in the combustile mixture supplied to an internal combustion engine. More particularly, the invention relates to a method and apparatus for controlling a combustible mixture on the basis of data from a λ or oxygen sensor disposed in the exhaust system for monitoring the presence of free oxygen and hence the composition of the combustible mixture supplied to the engine. The oxygen sensor supplies an actual value signal to the control loop permitting the latter to regulate the mixture.

B. State-of-the-Art

Known in the art are systems which determine the duration of fuel injection control pulses for an internal combustion engine on the basis of an alternating signal from a λ (oxygen) sensor located in the exhaust system of an internal combustion engine. The oxygen sensor signal is used by an appropriate mixture supply system for altering the fuel-air ratio. When an electric fuel injection system is used, the main variables for deriving the basic length of the fuel injection control pulses are the engine speed (rpm) and the air flow rate aspirated by the engine. The fuel injection control pulses are generated in synchronism with crankshaft revolutions or, alternatively, fuel may be injected continuously. The output signal from the λ-sensor is compared with a threshold voltage by a comparator circuit. The resulting signal is integrated and fed back to the mixture preparation system. One of the problems encountered in the known λ-sensor control systems is the operation in temperature domains where, due to the substantial cooling effect, the operation of the λ-sensor is critical because its output signal is indistinct or varies drastically. A further problem occurs when the known systems are used in internal combustion engines which have more than a single exhaust channel so that a single λ-sensor is able to monitor the exhaust gas composition and hence the fuel mixture composition only for one-half of the engine, for example.

OBJECT AND SUMMARY OF THE INVENTION

It is a principal object of the invention to provide a method and an apparatus for controlling the mixture of fuel and air fed to an internal combustion engine by monitoring the exhaust gas composition of preferably all the cylinders in the egine. It is a further object of the invention to provide a method and means for preventing the temperature of the λ-sensor to fall below a predetermined value, for example 400° C. These and other objects are attained, according to the invention, by providing at least two λ-sensors in the exhaust system of an internal combustion engine, located in different locations and associated with separate comparators for comparing the output voltage of each sensor with its own threshold voltage. Suitable circuitry is provided for combining the signals from the different λ-sensors for integration to generate an output signal which approximates a sawtooth wave and which is used to engage the mixture preparation components of the internal combustion engine. In one preferred construction, the output signals from the different comparators can be fed to the integrator in alternating fashion. In another preferred embodiment, the output signals from the two comparators can be coupled so as to obtain a predetermined control function, for example a two-point control or a three-point control.

The method and apparatus according to the invention provide the advantage with respect to the known systems of being capable of monitoring the exhaust gas of all the cylinders of an engine, especially a large engine, and to permit disposing the λ-sensors in such locations where the required high temperatures are normally guaranteed. Thus the invention permits closed loop control even under unfavorable conditions, for example in engine braking operation where temporary cooling of the exhaust system takes place and would normally impede the use of the λ-sensor signal in a feedback control loop.

The invention further provides circuits which permit processing the sensor output voltages to obtain different types of control, for example two-point or three-point control. The method and apparatus according to the invention may be used in association with any type of mixture preparation systems which supply a fuel-air mixture to an internal combustion engine, for example fuel injection systems, carburetors of any type of construction, etc.

The invention will be better understood as well as further objects and advantages thereof become more apparent from the ensuing detailed description of preferred exemplary embodiments taken in conjunction with the drawing.

DESCRIPTION OF THE PREFERRED EMBODIMENTS

Figure 1:
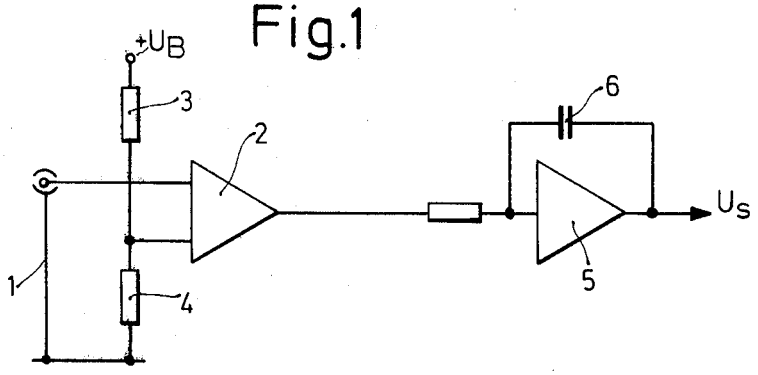
PRIOR ART Fig.1
FIG. 1 is a simplified schematic diagram of a known circuit for processing an oxygen sensor signal for use as a fuel mixture control signal.

It should be noted that the invention is primarily directed to only a portion of a fuel mixture preparation system, i.e., that portion which deals with the generation and processing of the output signal from the one or more λ-sensors which are located in the exhaust system and which provide an actual value signal for use in the mixture control. The field of the invention extends up to the circuit the output of which provides the integrated signal $U_s$ which fluctuates according to the mixture composition and which is then fed to subsequent circuits in the mixture preparation system, for example carburetors or fuel injection systems for adjusting the fuel mixture ratio. The circuit of particular interest to the present invention is shown in simplified representation in FIG. 1. This circuit is seen to include a λ-sensor 1 connected to the input of a comparator 2 which receives a threshold voltage from a voltage divider consisting of resistors 3 and 4 for comparison with the oxygen sensor signal. If necessary, the threshold or set-point voltage can be made adjustable so as to compensate for changes in the sensor voltage in the critical, relatively cool temperature region. The output of the comparator 2 is fed to an integrator 5 which, in the simplest case, may be an operational amplifier, the feedback path of which contains an integrating capacitor 6. The integrated sensor output voltage present at the output of the integrator 5 in approximately the form of a sawtooth wave, and whose period is equal to the dead time of the control system, is used to engage and adjust the mixture preparation mechanism. The remaining elements of the mixture preparation system are not the focus and subject of the present invention and will not be explained in greater detail. The remaining explanations and illustrations are related exclusively to that part of the circuit which extends from the sensor to the output of the integrator 5.

Figure 2:
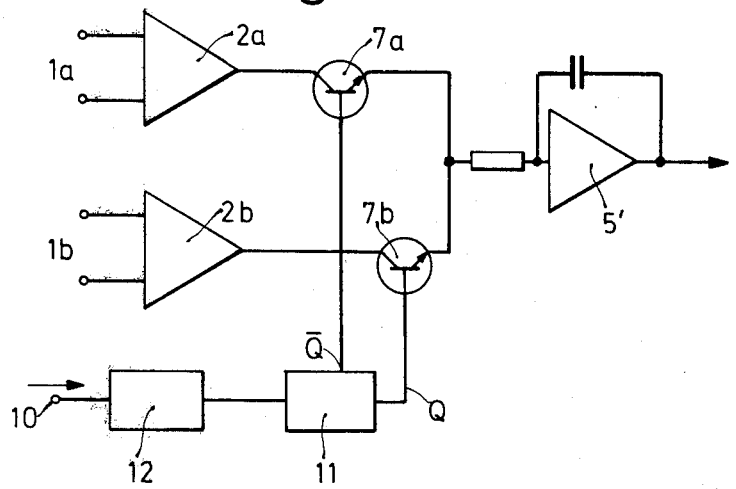
FIG. 2 is a circuit diagram of a first exemplary embodiment for combining a plurality of sensors and to connect their output to a known integrating circuit.

FIG. 2 is a block diagram of a first exemplary embodiment of the invention in which at least two separate λ-sensors are used for improved monitoring of the mixture composition. Each of the sensors 1*a* and 1*b* in FIG. 2 is associated with its own comparator 2*a* and 2*b*, respectively, the outputs of which are passed through the emittercollector paths of transistors 7*a* and 7*b*, respectively, and combined at the input of a subsequent integrator 5'. The output signals from the comparators 2*a* and 2*b* are switched to the input of the integrator 5' in alternating fashion by alternating switching of the transistors 7*a* and 7*b*. This alternating monitoring permits the disposition of the two λ-sensors in locations permitting the checking of the exhaust of all of the cylinders of the engine. For example, one of the λ-sensors may be used for monitoring the exhaust gas of one half of the engine while the other monitors the second half. Depending on the type of construction of the engine and of the exhaust system, it may also be reasonable to associate a λ-sensor with other predetermined groups of cylinders in the engine. It may also be suitable to provide a λ-sensor especially where it would normally acquire a high operating temperature very early. It is known to be important that the operating temperature of the sensors does not fall below approximately 400° C. even during unfavorable engine operation, for example engine braking or prolonged idling. By using several sensors, it is possible to dispose them closer to those regions of the exhaust system where it is easier to maintain the required temperatures and it is also easier to monitor the exhaust gas of a plurality of cylinders in large engines. The circuits according to the present invention insure that the actual value signal is representative of an average value of the various individual sensor output signals. On the other hand, the use of more than one λ-sensor, i.e., at least two λ-sensors, also permits a type of control which corresponds more closely to particular engine requirements or control requirements as will be explained in further detail below.

The signal from the λ-sensors 1*a* and 1*b* may be switched in synchronism with engine speed or with time. If the switching occurs at an rpm-related frequency, which is very useful if the remaining circuitry of the fuel injection system already contains rpm data, the rpm signal is fed to the contact 10 in FIG. 2 where it triggers a flip-flop circuit 11 so that the output signals Q and $\overline{Q}$ of the flip-flop 11 alternatingly render the transistors 7*a* and 7*b* conducting. If necessary, the rpm signal can be divided by a prior flip-flop 12. The constructions of multivibrators or flip-flops which are triggered by a periodically changing input signal to occupy one of two distinct states is known and will not be explained in further detail.

Figure 3A:
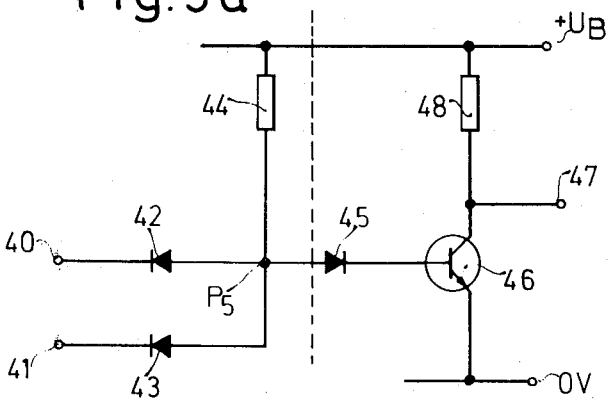
FIG. 3*a* illustrates a circuit for a NAND connection.
Figure 3:
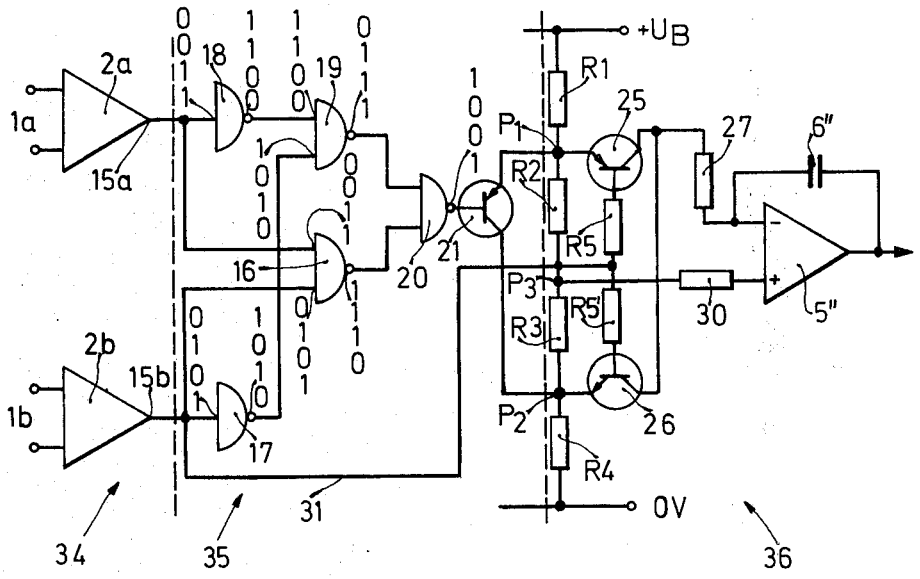
FIG. 3 is a detailed circuit diagram of a second exemplary embodiment for combining two sensors with an integrating circuit for three-point control.

A very sensitive control is obtained by using the circuit illustrated in FIG. 3 for generating a common integrator output signal composed of at least two sensor signals. As seen in FIG. 3, the output signals from the sensors 1*a* and 1*b* are coupled by logical circuitry in such a way as to obtain the following table.

| Sensor 1a | Sensor 1b | Control Output |
|---|---|---|
| richer | richer | richer |
| richer | leaner | blocked |
| leaner | richer | blocked |
| leaner | leaner | leaner |

The table is to be interpreted such that if both sensors call for a richer mixture, the control output will be a signal to enrich the mixture. If both sensor outputs call for a leaner mixture, the output will be such as to cause a lean mixture. However, if one sensor calls for a lean mixture while the other calls for a rich mixture, the output is blocked and the actual value signal remains at the value which it had prior to blockage. This type of logic prevents control oscillations and the entire system based on the circuit illustrated in FIG. 3 operates in the manner of a three-point controller having a central dead zone.

The manner in which the control behavior of the above table is obtained is that the outputs 15*a* and 15*b* are connected to separate inputs of a NAND gate 16 and are also inverted by gates 17 and 18, respectively. After inversion these outputs are fed to separate inputs of a further NAND gate 19. The outputs of the NAND gates 16 and 19 are then connected to separated inputs of a further NAND gate 20 whose output engages the base of a control transistor 21, the emitter-collector path of which joins two circuit junctions P1 and P2 which may, for example, lie at junctions of a voltage divider chain consisting of resistors R1, R2, R3 and R4 connected between the available supply potentials. Also connected to the circuit points P1 and P2 are, respectively, transistors 25 and 26 whose collectors are joined and are coupled with the inverting input of a subsequent integrator 5'', possibly through an input resistor 27. Feedback is provided by a feedback capacitor 6''. The other input of the integrator which may be an operational amplifier, is connected to a point P3 defined by the junction of the resistors R2 and R3. The base electrodes of the transistors 25 and 26 are coupled, preferably via equal-valued resistors R5 and R5', to the output of one of the comparators 2*a* or 2*b*; in the exemplary embodiment illustrated they are shown to be joined to the output 15*b* of the comparator 2*b*. In the explanation of the functioning of this circuit which follows, it will be assumed that the values of the resistors R1 and R4 are equal as are those of the resistors R2 and R3, so that approximately symmetric voltage divisions take place.

It will be further assumed that the outputs 15*a* and 15*b* of the sensor comparators 2*a* and 2*b* may exhibit either a logical 0 or a logical 1 depending on whether the associated sensor output voltage is larger or smaller than the set-point value. Thus, it will not be necessary to examine the various switching states all the way back to the rich or lean conditions of the input mixture composition which would merely make the explanation more difficult. Shown adjacent to the inputs of the various gates, which are all NAND gates in the exemplary embodiment of FIG. 3, are columns of logical symbols, i.e., 0 and 1, and similar symbols are shown adjacent to the outputs of the gates. The various positions in the columns are meant to be interpreted in association; for example, if a logical 1 is associated with the command for a richer mixture from each sensor as obtained at the outputs 15*a* and 15*b* of the comparators 2*a* and 2*b*, then the inputs of the NAND gate 16 will have a logical 1 whereas the inputs of the NAND gate 19 will see a logical 0 because of the inversion by the gates 17 and 18. Thus, the output of the NAND gate 16 is a logical 0 while the output of the NAND gate 19 is a logical 1, leading finally to a logical 1 at the output of the NAND gate 20. If a logical 1 is defined as high or positive potential, then the subsequent transistor 21 will be seen to be blocked because, due to the connection of its emitter to the point P1, its emitter voltage will be less than the value of the logical 1 signal which may, for example, be the same as the voltage supply $+U_B$.

It may easily be verified that the same output signal (a logical 1) will be present at the input of the transistor 21 if both comparator outputs exhibit a logical 0, due to the symmetrical connection. Only when the comparator outputs are different does the input of the transistor 21 receive a logical 0 for, in that case, the inputs of the NAND gate 16 are a logical 0 and a logical 1, causing its output to be a logical 1. However, the inputs of the NAND gate 19 are, respectively, 0 and 1, making its output also a logical 1. Thus, the output of the NAND gate and, therefore, the input of the transistor 21, both see a logical 0 which, according to the adopted definition, will correspond to a low or a negative potential, causing the transistor 21 to conduct. When the transistor 21 conducts, the points P1 and P2 are at approximately the same potential so that the emitter voltages of the switching transistors 25 and 26 are approximately equal to the potential at the point P3. Thus, no matter whether other circuit conditions cause the transistor 25 or the transistor 26 to conduct, it is able to supply to the illustrated inverting input of the integrator 5″ only the voltage at the point P3 which the non-inverting input receives through the resistor 30. Thus the integrator 5″ remains at whatever output level it had previously obtained and the control process may be said to be blocked when the two sensors 1*a* and 1*b* have different output signals, as was assumed in the present discussion.

The further function is such that the output of the comparator 15*b* will be a logical 1 if, as agreed, the output of the comparator 2*a* shows a logical 0, due to the connection of the base electrodes of the transistors 25 and 26 to the output 15*b* via the line 31. This results in an unambiguous control due solely to the connection of the base electrodes of the transistors 25 and 26 to one of the sensor or comparator outputs. For example, if the output 15*b* of the comparator 2 is at low potential (logical 0) then the transistor 26 is blocked because its emitter is at the voltage of point P2 which is more positive than for example 0 volt, whereas the transistor 25 conducts and connects the inverting input of the integrator 5″ with a more positive voltage than present at the non-inverting input which lies at the mean voltage of the voltage divider circuit. If, however, the output of the comparator 2*b* exhibits a logical 1 and if, according to the assumption, the output of the comparator 2*a* has a logical 0, so that the transistor 21 is not effective, then the transistor 26 conducts, the transistor 25 is blocked and the inverting input of the operational amplifier 5″ receives a more negative voltage than is present at the other input, thereby causing the operational amplifier to integrate in the opposite direction.

The circuit of FIG. 3 thus may be said to consist substantially of an input comparison circuit 34 which insures unambiguous voltages at the outputs of the comparators 2*a* and 2*b* by comparing the sensor output voltages with suitable set-point voltages. The circuit of FIG. 3 further includes a coupling circuit 35 which insures that when the sensor output signals are different, these signals are not passed on and a reaction by the integrating circuit is suppressed. A further circuit portion is the control circuitry 36 which acts on the integrator and which is able to respond whenever the sensor output signals and thus the comparator signals have the same logical value.

The gate circuits used in the exemplary embodiment of FIG. 3 are NAND gates which are known to the person skilled in the art. However, FIG. 3 illustrates a possible construction of a NAND gate which may be used in the circuit of FIG. 3. The inputs 40 and 41 of the NAND gate of FIG. 3*a* are connected to the cathodes of series diodes 42 and 43, the anodes of which are joined at a point P5 which is further connected through a resistor 44 to the positive supply voltage $U_{B+}$. This part of the circuit acts as an AND gate because when both inputs 40 and 41 are positive (logical 1), the diodes are blocked and the point P5 is at positive potential (logical 1). The transistor 46 controlled by the point P5 via the diode 45 inverts the voltage present at its base so that the overall functioning of the circuit is that of a NAND gate whose output 47 is then taken from the collector of the transistor 46 which is also connected through a resistor 48 to the positive supply line.

Figure 4:
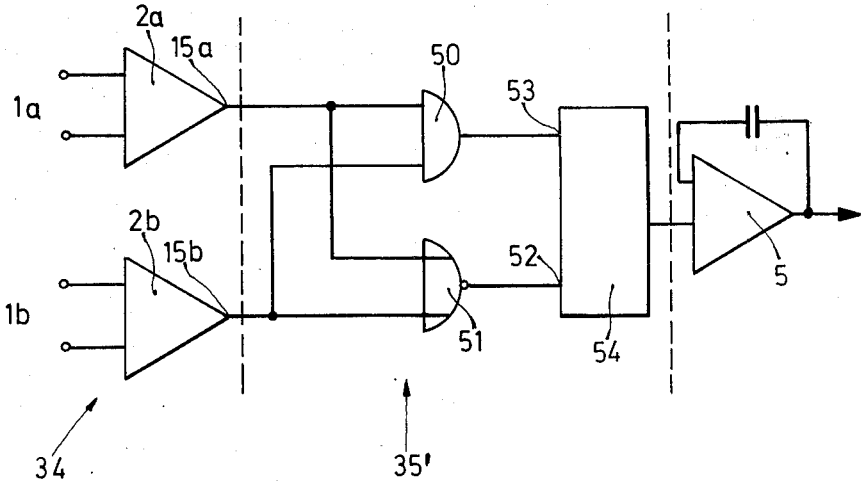
FIG. 4 is a block diagram of a further exemplary embodiment of a sensor voltage processor circuit providing two-point control.

FIG. 4 is a schematic illustration of a further possibility for processing more than one sensor output signal for use in a fuel injection system. In this circuit, the fuel mixture controller receives only two commands, namely richer or leaner, even if the sensors show a different output signal. As before, the circuit of FIG. 4 includes an input comparator circuit 34 which corresponds to that already explained in detail in connection with FIG. 3. Following the comparator circuit 34 is a coupling circuit 35 including a bistable multivibrator which is so connected that the integrator runs in the direction of a leaner mixture if both sensors indicate a rich mixture. If one sensor indicates a lean mixture while the other indicates a rich mixture, the integrator continues to run in the previous direction and receives a well defined input signal until both sensors finally agree and supply the same signal. Thus, if both sensors had previously indicated a lean mixture, the integrator continues to run in the direction of a rich mixture, i.e., in the previous sense, even if one of the sensors now indicates a rich mixture. Only if the other sensor also indicates a rich mixture does the integrator start to operate in the opposite direction, i.e., it then switches over to a control state where the subsequent fuel injection system causes the fuel-air mixture to be leaned-out.

In the circuit of FIG. 4, each of the outputs of the comparators 2*a* and 2*b* is seen to be connected with one input of a subsequent AND circuit 50 as well as to an input of a NOR gate 51. The output of the NOR gate 51 is connected to one input 52 of a bistable multivibrator 54 while the other input 53 of the multivibrator 54 is connected to the output of the AND gate 50. One of the outputs of the multivibrator 54 controls the subsequent integrator 5' with a signal which may be either a logical 0 or a logical 1.

Figure 4A:
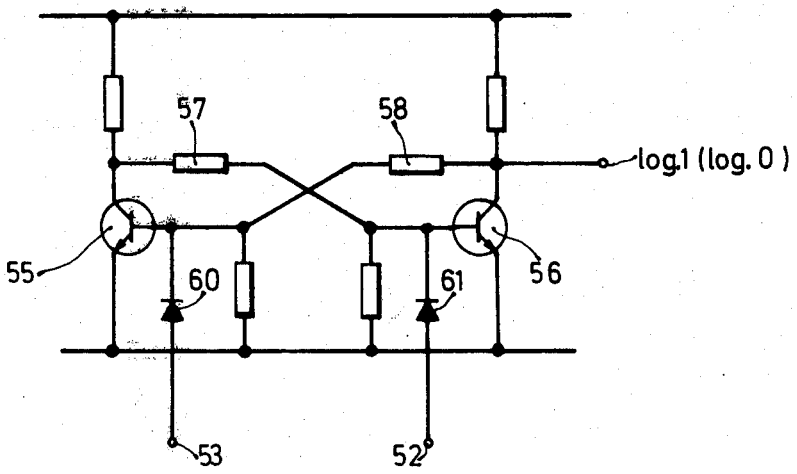
FIG. 4*a* is a diagram illustrating one type of bistable flip-flop as used in the circuit of FIG. 4.

FIG. 4*a* is an illustration of one circuit which may be used as the bistable multivibrator 54. In the simplest case, this circuit includes two transistors 55 and 56 in which each base is connected to the collector of the other transistor via resistors 57 and 58, respectively. The base electrodes are controlled through input contacts 52 and 53 via diodes connected to pass positive input currents.

The circuit states resulting from the various output signals from the comparators 2*a* and 2*b* will now be examined. If both outputs of the comparators are logical 1, then the output of the AND gate 50 will be a logical 1 while the output of the NOR gate will be a logical 0. Thus, if logical 1 is identified with a positive voltage, the transistor 55 will be rendered conducting via the diode 60, while the transistor 56 blocks so that its collector carries a logical 1. If both comparator outputs are logical 0, the opposite output is obtained for, in that case, the transistor 56 conducts and its output is a logical 0 which is fed to the integrator 5. If, during this condition, the output 15*b* of the comparator 2*b* for example changes into the state logical 1, the output of the AND gate 50 is unchanged (remaining at 0) while the output of the NOR gate 51 changes from a logical 1 to a logical 0. However, a negative-going voltage at the input 52 of the flip-flop 54 only blocks the diode 61 and does not alter the state of the multivibrator so that the integrator continues to receive the same input signal. Only after the sensor 1*a* also changes its output, thus causing the output 15*a* of the comparator 2*a* to switch to a logical 1, does the positive voltage at the input 63 of the transistor 55 render the latter conducting so that the flip-flop now shifts over into its other state.

It will be appreciated that the various circuits shown could be altered in various ways; in particular more than two sensors can be used and combined to actuate the integrator. In the simplest case, this can be done in the exemplary embodiment of FIG. 2 by connecting as many sensors and comparators as desired in parallel and to connect them to the integrator via an appropriate number of transistors. The electrical connection to the integrator can take place cyclically, for example by means of a time multiplex circuit.

As already indicated, the invention may be used in association with all types of mixture preparation systems, for example those employing carburetors, fuel injection systems and the like. When carburetors are used, the nozzle cross section for supplying fuel to the induction tube may be altered. However, other parts of the carburetor may be engaged to changed the fuel-air mixture ratio under the control of the λ-sensor signal.

The invention may be used especially for controlling the exhaust gas recycle rate in mixture preparation systems, as well as for controlling the flow through bypass lines. It may also be used for supplying an additional control parameter for changing the duration of fuel injection control pulses, for example in the multiplication stage of such systems. Generally, a λ-sensor and the associated processing components as described in this invention may be used in all systems and installations which provide fuel to the combustion regions of engines either via vacuum aspiration or by means of pressure.

The foregoing relates to merely preferred exemplary embodiments of the invention, it being understood that other embodiments and variants thereof are possible within the spirit and scope of the invention.

What is claimed and desired to be secured by letters patent of the United States is:

1. A method of controlling the component ratio of a fuel-air mixture delivered to an internal combustion engine depending upon the oxygen content of the exhaust gases, the steps comprising:

a. sensing the oxygen content of the exhaust at at least two different points spaced substantially from one another within the exhaust channel system and generating first and second electrical signals proportional thereto;

b. comparing said first and second electrical signals separately with threshold signals in separate comparators;

c. integrating the signals from said comparators in a single integrator alternately cyclically to produce an integrated control signal; and d. altering the fuel-air ratio in accordance with said integrated control signal.

2. A method of controlling the component ratio of a fuel-air mixture delivered to an internal combustion engine depending upon the oxygen content of the exhaust gases, the steps comprising:

a. sensing the oxygen content of the exhaust at at least two different points spaced substantially from one another within the exhaust channel system and generating first and second electrical signals proportional thereto;

b. comparing said first and second signals separately with threshold signals in separate comparators;

c. sensing the logical identity of the signals from said comparators and integrating said signals only when they are logically identical; and d. altering the fuel-air ratio in accordance with said integrated control signal.

3. A method for determining the component ratio of a fuel-air mixture delivered to an internal combustion engine having a sensor (oxygen sensor) for detecting the exhaust gas composition, which additionally influences the composition of the operational mixture and whereby the output signal of the sensor is compared in a comparator circuit with a threshold signal and subsequently integrated and fed back to the mixture preparation apparatus, characterized in that (a) providing at least two oxygen sensors disposed at differing locations in the exhaust channel system, that (b) feeding the output signals of the said at least two oxygen sensors through a subsequent linkage circuit, to a single integrator circuit in the form of an input signed whereby when the sensor output signals are pointing in the same direction, the input signal delivered to said integrator circuit is unequivocally formed in the direction of control and that when the sensor output signals differ, the integrator input signal which corresponds to the last unequivocal output signal of both sensors is maintained.

4. Apparatus for controlling the fuel-air mixture of an internal combustion engine in accordance with the oxygen content of the exhaust gases comprising:

at least two oxygen sensors mounted at different spaced apart locations within the exhaust gas system of the engine for generating electrical signals proportional to oxygen content at said different locations;

at least two comparator means, one connected to each of said sensors respectively for comparing separately each of said signals with threshold signals;

control means for adjusting the fuel-air ratio supplied to the engine;

an integrator having its output connected to said control means;

coupling means connecting the output of said comparators to the input of said integrator to provide a datum to said integrator comprising the signals generated by said comparators and from additional control information;

a switch associated with the output of each of said comparator means; and means for alternately switching said switches.

5. Apparatus for controlling the fuel-air mixture of an internal combustion engine in accordance with the oxygen content of the exhaust gases comprising:

at least two oxygen sensors mounted at different spaced apart locations within the exhaust gas system of the engine for generating electrical signals proportional to oxygen content at said different locations;

at least two comparator means, one connected to each of said sensors respectively for comparing separately each of said signals with threshold signals;

control means for adjusting the fule-air ratio supplied to the engine;

an integrator having its output connected to said control means;

coupling means connecting the output of said comparators to the input of said integrator to provide a datum to said integrator comprising the signals generated by said comparators; and a transistor associated with the output of each of said comparator means having collector-emitter paths connected at one end with the outputs of said comparator means and at the other end with an input of said integrator and a flip-flop circuit for providing alternate switching signals to said transistors.

6. Apparatus for controlling the fuel-air mixture of an internal combustion engine in accordance with the oxygen content of the exhaust gases comprising:

at least two oxygen sensors mounted at different spaced apart locations within the exhaust gas system of the engine for generating electrical signals proportional to oxygen content at said different locations;

at least two comparator means, one connected to each of said sensors respectively for comparing separately each of said signals with threshold signals;

control means for adjusting the fule-air ratio supplied to the engine;

an integrator having its output connected to said control means;

coupling means connecting the output of said comparators to the input of said integrator to provide a datum to said integrator comprising the signals generated by said comparators; and said coupling means includes means for blocking the provision of a datum to said integrator when said output signals from said individual comparators have opposite logical character.

7. Apparatus for controlling the fuel-air mixture of an internal combustion engine in accordance with the oxygen content of the exhaust gases comprising:

at least two oxygen sensors mounted at different spaced apart locations within the exhaust gas system of the engine for generating electrical signals proportional to oxygen content at said different locations;

at least two comparator means, one connected to each of said sensors respectively for comparing separately each of said signals with threshold signals;

control mens for adjusting the fuel-air ratio supplied to the engine;

an integrator having its output connected to said control means;

coupling means connecting the output of said comparators to the input of said integrator to provide a datum to said integrator comprising the signals generated by said comparators; and said comparator means including an input comparison circuit comprising a comparator, a linkage circuit having at least two inputs, means for connecting the outputs of said comparators to said at least two inputs of said linkage circuit, whereby then the sensor output signals are identical said linkage circuit delivers an unequivocal output signal suitable for integration to a single subsequent integrator and that when the sensor output signals are different said integrator is either blocked by said linkage circuit or continues to integrate in the same direction.

8. A closed loop control system for controlling the ratio of the air/fuel mixture supplied to an internal combustion engine having two cylinder basnks and separate exhaust gas manifolds for each cylinder bank, the system comprising:

air/fuel mixture delivery means, the delivery means being effective to supply an air/fuel mixture to each of the cylinder banks, the air/fuel ratios of the mixtures supplied to the cylinder banks having relative values determined by the characteristics of the engine and the delivery means;

means responsive to the content of the exhaust gas output of each of the exhaust gas manifolds effective to generate respective first and second air/fuel ratio signals each being switched between first and second voltage values in accord with the relationship of a sensed air/fuel ratio relative to a predetermined ratio;

means effective to generate a control signal having a value progressively increasing in response to a first combination of the voltage values of the first and second air/fuel ratio signals and being a value progressively decreasing in response to a second combination of the voltage values of the first and second air/fuel ratio signals; and control means effective to control each of the air/fuel mixture delivery means in accord with the instantaneous value of the control signal.

9. A closed loop control system for controlling the ratio of the air/fuel mixture supplied to an internal combustion engine having two cylinder banks and separate exhaust gas manifolds for each cylinder bank, the system comprising:

air/fuel mixture delivery means, the delivery means being effective to supply and air/fuel mixture to each of the cylinder banks, the air/fuel ratios of the mixtures supplied to the cylinder banks having relative values determined by the characteristics of the engine and the delivery means;

means responsive to the content of the exhaust gas output of each of the exhaust gas manifolds effective to generate respective first and second air/fuel ratio signals each changing abruptly between first and second voltage values in accord with the relationship of a sensed air/fuel ratio relative to a predetermined ratio;

means responsive to the first and second air/fuel ratio signals effective to generate a control signal having (A) a value progressively increasing when the air/fuel ratio signals are both at the first voltage value, (B) a value progressively decreasing when the air/fuel ratio signals are both at the second voltage value and (C) a value held constant when the air/fuel ratio signals are at different voltage values; and control means effective to control each of the air/fuel mixture delivery means in accord with the instantaneous value of the control signal, the means value between the air/fuel ratios of the mixtures supplied to the cylinder banks being equal to the predetermined ratio.

10. A closed loop control system for controlling the ratio of the air/fuel mixture supplied to an internal combustion engine having two cylinder banks and separate exhaust gas manifolds for each cylinder bank, the system comprising:

first and second air/fuel mixture delivery means, each of said delivery means being effective to supply an air/fuel mixture to a respective one of the cylinder banks, the air/fuel ratios of the mixtures supplied to the cylinder banks having relative values determined by the characteristics of the first and second delivery means;

means responsive to the content of the exhaust gas output of each of the exhaust gas manifolds effective to generate respective first and second air/fuel ratio signals each being switched between first and second voltage values in accord with the relationship of a sensed air/fuel ratio relative to a predetermined ratio:

means responsive to the first and second air/fuel ratio signals effective to generate a control signal having (A) a value progressively increasing when the air/fuel ratio signals are both at the first voltage value, (B) a value progressively decreasing when the air/fuel ratio signals are both at the second voltage value and (C) a value held constant when the air/fuel ratio signals are at different voltage values; and control means effective to control each of the air/fuel mixture delivery means in accord with the instantaneous value of the control signal, the mean value between the air/fuel ratios of the mixtures supplied to the cylinder banks being equal to the predetermined ratio.

* * * * *